United States Patent [19]

Hayashi

[11] 4,084,866

[45] Apr. 18, 1978

[54] DOOR STRUCTURE

[76] Inventor: Kikuo Hayashi, 21452 DeQuindre, Warren, Mich. 48091

[21] Appl. No.: 738,587

[22] Filed: Nov. 3, 1976

[51] Int. Cl.[2] ..... A47B 77/08

[52] U.S. Cl. ..... 312/138 R; 312/236

[58] Field of Search ..... 312/138 R, 138 A, 214, 312/236, 320, 322, 324–327

[56] References Cited

U.S. PATENT DOCUMENTS

| | | | |
|---|---|---|---|
| 2,064,972 | 12/1936 | Eickmeyer | 312/138 A |
| 2,826,471 | 3/1958 | Fonda | 312/138 A |
| 2,984,533 | 5/1961 | Sundberg | 312/138 A |

*Primary Examiner*—Casmir A. Nunberg

[57] ABSTRACT

A door having an interior surface and opposite edge surfaces. One or more hinges being mounted on one edge surface. A plurality of spaced-apart rear-opening shelves are mounted to the interior surface and extend inwardly thereof. A plurality of spaced-apart edge-opening shelves are mounted to the interior surface and extend inwardly of the interior surface a distance greater than the extension of the rear-opening shelves. The door has particular usefulness as a refrigerator door, inasmuch as the edge-opening shelves are accessible when the door is only slightly open, thereby preventing the cold air within the refrigerator from escaping and saving energy.

16 Claims, 3 Drawing Figures

DOOR STRUCTURE

BACKGROUND OF THE INVENTION

1. Field of the Invention

The invention relates to doors having shelves attached to the interior surface thereof, more particularly to doors having shelves oriented in a manner so that access may be easily gained to at least a portion of the shelves with a very little opening of the door and specifically to a refrigerator door having such structure.

2. Description of the Prior Art

The prior art contains doors having shelves attached thereto. However, none of these doors known to applicant allow easy access to items on such shelves with only a slight opening of the door, and can be used as a refrigerator door for conserving energy by significantly reducing the temperature change in the refrigerator upon the opening of the door.

SUMMARY OF THE INVENTION

It is therefore an object of the invention to provide an improved door structure.

It is therefore an object of the invention to provide an improved refrigerator door structure.

It is therefore another object of the invention to provide a door having shelves which are easily accessible with only a slight opening of the door.

It is finally an object of the invention to provide an improved refrigerator door which will allow easy access to items stored on its shelves without a significant temperature change in the refrigerator.

In the broader aspects of the invention, a door is provided having a plurality of spaced apart rear-opening and edge-opening shelves attached to the interior side thereof. In a specific embodiment, each rear-opening shelf is connected to its respective edge-opening shelf. Used as a refrigerator door, the door is hinged to the refrigerator at one edge surface thereof. The shelves are contained within the refrigerator. The front portion of the shelves and drawers within the refrigerator are contoured so as to be complementary to the configuration of the rear-opening and edge-opening shelves of the door.

BRIEF DESCRIPTION OF THE DRAWINGS

The above mentioned and other features and objects of this invention and the manner of attaining them will become more apparent and the invention itself will be best understood by reference to the following description of the invention taken in conjunction with the accompanying drawings wherein.

DESCRIPTION OF A SPECIFIC EMBODIMENT

Figure 2:
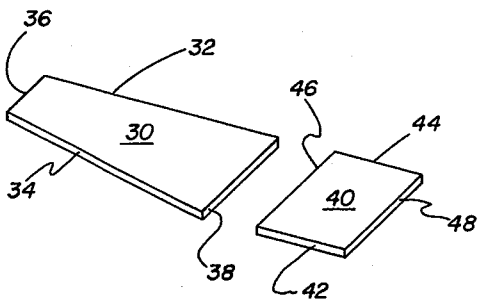
FIG. 2 is a perspective view of the rear-opening and edge-opening shelves of the improved door structure of the invention.
Figure 1:
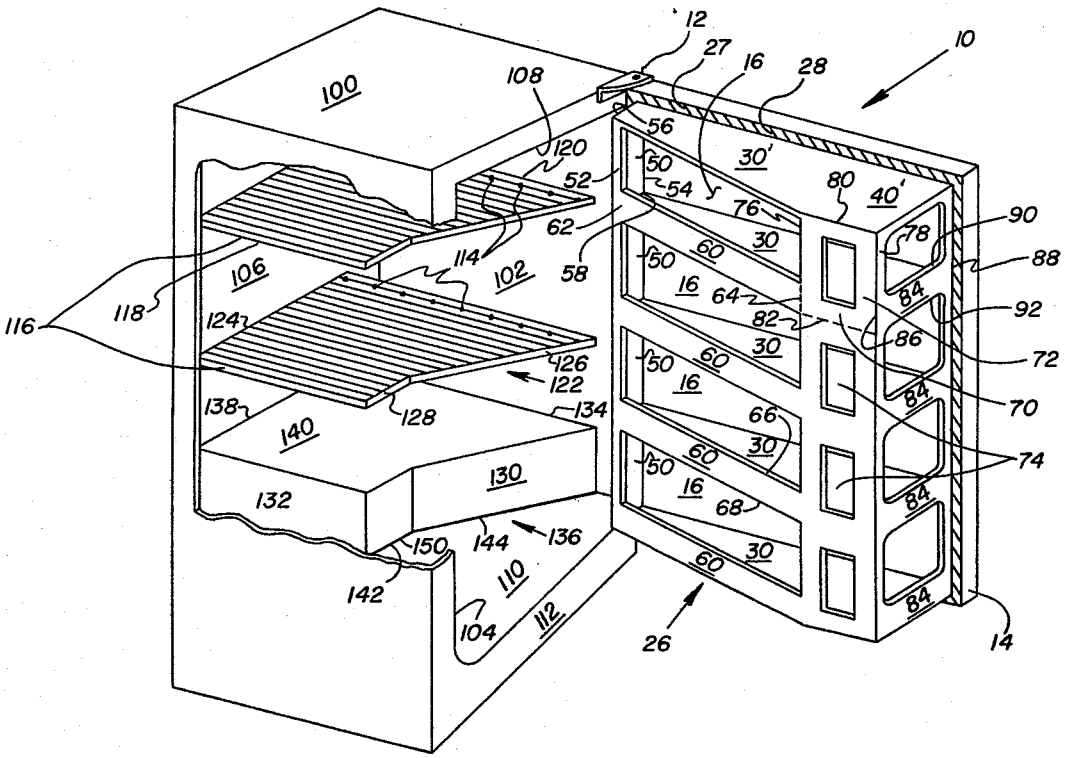
FIG. 1 is a perspective and broken away view of a refrigerator having a door of the invention, showing the door in an opened condition.

Referring to FIGS. 1 and 2, the door of the invention is shown to comprise a door member 10 having opposite edge surfaces 12 and 14, an interior surface 16, and an exterior surface 18. Handle 20 is mounted on exterior surface 18. Hinges 22 and 24 are mounted on edge surface 12. Shelf assembly 26 is mounted to interior surface

16. The dimensions of shelf assembly 26 are such that a peripheral ledge 27 surrounds shelf assembly 26. Gasket 28 is affixed to peripheral ledge 27.

Rear-opening shelf 30 has opposite sides 32 and 34, and parallel opposite ends 36 and 38. In the specific embodiment illustrated, the length of end 36 is less than the length of end 38 and side 34 converges toward side 32 as it extends toward end 36.

Edge-opening shelf 40 is opposite sides 42 and 44, and opposite ends 46 and 48. In the specific embodiment illustrated, sides 42 and 44 are parallel and of the same length and ends 46 and 48 are parallel and of the same length. Rear-opening shelf 30 extends generally horizontally and perpendicularly from interior surface 16, side 32 being contiguous to interior surface 16. Edge-opening shelf 40 also extends generally horizontally perpendicularly from interior surface 16, side 44 being contiguous to interior surface 16. In the specific embodiment illustrated, both rear-opening shelf 30 and edge-opening shelf 40 define generally the same horizontal plane and are attached together.

End member 50 has generally parallel opposite sides 52 and 54, and generally parallel top 56 and bottom 58 ends. End member 50 is generally vertically mounted generally perpendicularly to interior surface 16 at side 54. Top 56 is attached to the upper rear-opening shelf 30'. Bottom end 58 is attached to the lower rear-opening shelf 30. End member 50 is also generally perpendicular to both the lower and upper rear-opening shelves 30 and 30'.

Retainer rail 60 has opposite generally parallel edges 62 and 64 and generally parallel top 66 and bottom 68 sides. Edge 62 is attached to end member 50. Bottom side 68 is attached to side 34 of rear-opening shelf 40. Edge 64 is attached to air circulation member 70. Retainer rail 60 is generally perpendicular to both end member 50 and to rear-opening shelf 30.

Air circulation member 70 comprises a generally vertical member 72 having a plurality of apertures 74 therein. Vertical member 72 has opposite edges 76 and 78 and top 80 and bottom 82 ends. Top end 80 being attached to the upper edge-opening shelf 40'. Bottom end 82 being attached to the lower edge-opening shelf 40. Vertical member 72 being generally perpendicular to both upper and lower edge-opening shelves 40 and 40'.

Rail member 84 has opposite ends 86 and 88 and top 90 and bottom 92 sides. End 86 is attached to vertical member 72. End 88 is attached generally perpendicularly to interior surface 16. Bottom side 92 is attached to edge-opening shelf 40. Rail member 84 is generally perpendicular to both vertical member 72 and edge-opening shelf 40.

Each of the shelves 30 and 40 are identical. Thus, the description above will suffice for all.

Figure 3:
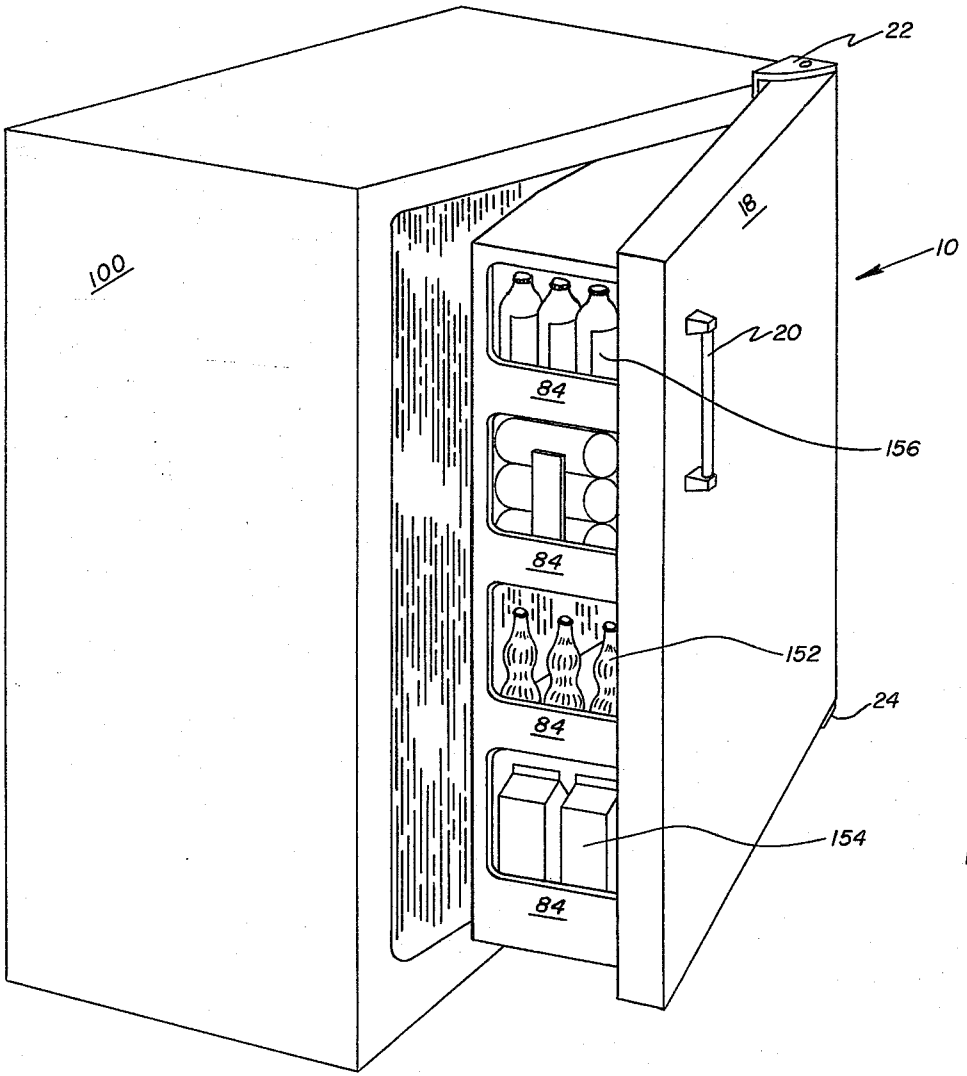
FIG. 3 is a perspective view of the refrigerator illustrated in FIG. 1, showing the door slightly ajar.

Referring to FIGS. 1 and 3, refrigeration chamber 100 is shown to have opposite interior sides 102 and 104, an interior rear surface 106, an interior top surface 108, an interior bottom surface 110, and a front exterior edge surface 112. Generally horizontal rows of spaced-apart support pegs 114 are positioned so as to extend from sides 102 and 104. A plurality of food shelves 116 rest upon the rows of support pegs 114, and thus are contained within chamber 100 in generally horizontal, parallel, spaced-apart fashion. Each food shelf 116 has opposite sides 118 and 120, and opposite front 122 and rear 124 ends. Front end 122 has an angular portion 126 extending inwardly toward rear end 124 and a portion 128 extending generally parallel to rear end 124.

A food drawer 130 is provided to rest on bottom 110 of chamber 100. Food drawer 130 having opposite sides 132 and 134, opposite front and rear edges 136 and 138, and top 140 and bottom 142 ends. Top end 140 of food drawer 130 being parallel and spaced-apart from the lower most food shelf 116. Front edge 136 has an angular portion 144 extending inwardly toward rear edge 138 and portion 150 extending generally parallel to rear edge 138.

When food shelves 116 rest upon support pegs 114, sides 118 and 120 are adjacent sides 102 and 104 respectively, rear end 124 is adjacent interior rear surface 106. Similarly, when food drawer 130 rests upon bottom 110 of chamber 100, sides 132 and 134 are adjacent sides 104 and 102, respectively, and rear edge 138 is adjacent interior rear surface 106. Both front end 122 and front edge 136 are complementary to the configuration of shelf assembly 26 such that when door member 10 is closed, shelves 116 and drawer 130 and shelf assembly 26 all fit together and no space within chamber 100 is unuseable.

The invention provides a door which allows for convenient access to the shelves 40 attached thereto without fully opening door member 10. Referring to FIG. 3, door member 10 is shown to be particularly suited for use with a refrigeration chamber 100. A variety of often-used products such as soft drinks 152, milk 154, and beer 156, can be placed in edge-opening shelves 40. The above-mentioned items may also be placed on rear-opening shelves 30. Rail member 84 and vertical member 72 prevents any of the above-mentioned items from falling off of edge-opening shelf 40. Rail member 60 prevents the items from falling off of rear-opening shelves 30.

The above-mentioned items located on edge-opening shelves 40 are refrigerated by the movement of cooled air through apertures 74. Consequently, items placed in edge-opening shelves 40 will become refrigerated as quickly as if they had been placed on food shelves 116 or on rear-opening shelves 30.

Whenever a user desires one of the above-mentioned products, he need only open door member 10 at a distance sufficient to allow his hand to gain access to the items located adjacent rail member 84. Consequently, door member 10 is not open very far and the ambient air is restricted from entering cooling chamber 100, and cooled air is restricted from leaving cooling chamber 100.

While there have been described above the principles of this invention in connection with specific apparatus, it is to be clearly understood that this description is made only by way of example and not as a limitation to the scope of the invention.

What is claimed is:

1. A door comprising a door member having an interior surface and opposite edge surfaces, hinge means mounted on one of said edge surfaces, a plurality of spaced-apart rear opening shelves extending inwardly of said interior surface, said rear-opening shelves having access openings in said interior surface, and a plurality of spaced-apart edge opening shelves extending inwardly of said other edge surface, said edge-opening shelves having access openings in said other edge surface, whereby access is provided to said edge opening shelves when said door is partially open.

2. The door of claim 1 wherein said rear-opening shelves have opposite sides and opposite ends, one of said sides being mounted to said door, the other of said sides partially defining said interior surface of said door and having a retainer means attached thereto, one of said ends having an end member attached thereto closing said one end, said edge-opening shelves having opposite sides and opposite ends, one of said edge-opening ends being mounted to said door, the other of said edge-opening ends having an end member attached thereto closing said said other end, one of said edge-opening sides communicating with the other of said ends of said rear-opening shelves.

3. The door of claim 2 wherein said rear-opening shelves and said edge-opening shelves are continuous.

4. The door of claim 2 wherein said edge-opening end member has a plurality of apertures therein, there being at least one of said apertures for each of said edge-opening shelves, said apertures being smaller than most items normally placed on said edge-opening shelves, whereby said items are retained on said shelves and air rearward of said interior surface can circulate to and from said edge-opening shelves.

5. The door of claim 4 wherein said edge-opening end member and said other sides of said rear-opening shelves fully define said interior surface.

6. The door of claim 2 wherein said other sides of said rear-opening shelves converge to said one sides thereof, the length of said one end of said rear opening shelves being smaller than the length of said other ends of said rear-opening shelves, said one rear-opening shelf ends being adjacent to said one door edge surface.

7. The invention of claim 2 wherein said end members are generally perpendicular to said shelves, and said shelves are generally parallel and horizontal.

8. The door of claim 2 wherein said topmost and bottommost shelves and said rear-opening shelf end member enclose said intermediate rear-opening shelves on three sides thereof, thereby restricting the flow of air from adjacent said interior surface around said door when said door is slightly ajar.

9. A refrigerator having a cooling chamber and having an access opening comprising, a refrigerator door for closing said access opening, said door having interior and exterior surfaces and opposite edge surfaces, hinge means mounted on one of said edge surfaces, a plurality of spaced-apart rear-opening shelves extending inwardly of said interior surface, and a plurality of spaced-apart edge-opening shelves extending inwardly of said other edge surface; said refrigerator having a front edge surface surrounding said access opening, said chamber having a rear and a top and bottom and opposite sides, support means located within said chamber for supporting storage means, a plurality of storage means supported by said support means.

10. The refrigerator of claim 9 wherein said rear-opening shelves have opposite sides and opposite ends, one of said sides being mounted to said door, the other of said sides partially defining said interior surface and having a retainer means attached thereto, one of said ends having an end member attached thereto closing said one end, said edge-opening shelves having opposite sides and opposite ends, one of said edge-opening ends being mounted to said door, the other of said edge-opening ends having an end member attached thereto closing said other end, one of said edge-opening sides communicating with the other of said ends of said rear-opening shelves, said edge-opening end member has a plurality of apertures therein, there being at least one of said apertures for each of said edge-opening shelves, said apertures being smaller than most items normally placed on said edge-opening shelves, whereby said items are retained on said shelves and air rearward of said interior surface can circulate to and from said edge-opening shelves, said edge-opening end member and said other sides of said rear-opening shelves fully define said interior surface, said topmost and bottommost shelves and said rear-opening shelf end member enclose said intermediate rear-opening shelves on three sides thereof, thereby restricting the flow of air from adjacent said interior surface around said door when said door is slightly ajar.

11. The refrigerator of claim 10 wherein said storage means comprises racks having opposite sides, and front and rear ends.

12. The refrigerator of claim 9 wherein said storage means comprises a refrigerator drawer having a top and bottom and opposite side and front and rear edges.

13. The refrigerator of claim 9 wherein said rear-opening shelves and said edge-opening shelves are continuous.

14. The refrigerator of claim 9 wherein said edge-opening shelves have opposite sides and opposite ends, one of said edge-opening ends being mounted to said door, the other of said edge-opening ends having an end member attached thereto closing said other end, said edge-opening end member having a plurality of apertures therein, there being at least one of said apertures for each of said edge-opening shelves, said apertures being smaller than most items normally placed on said edge-opening shelves, whereby said items are retained on said shelves and air rearward of said interior surface can circulate to and from said edge-opening shelves.

15. The refrigerator of claim 14 wherein said rear-opening shelves have opposite sides and opposite ends, one of said sides being mounted to said door, the other of said sides partially defining said interior surface, said edge-opening end member and said other sides of said rear-opening shelves fully define said interior surface.

16. The refrigerator of claim 9 wherein said rear-opening shelves have opposite sides and opposite ends, one of said ends having an end member attached thereto, said topmost and bottommost shelves and said rear-opening shelf end member enclose said intermediate shelves on three sides thereof, thereby restricting the flow of air from adjacent said interior surface around said door when said door is slightly ajar.

* * * * *

UNITED STATES PATENT OFFICE

CERTIFICATE OF CORRECTION

Patent No. 4,084,866 Dated April 18, 1978

Inventor(s) Kikuo (nmi) Hayashi

It is certified that error appears in the above-identified patent and that said Letters Patent are hereby corrected as shown below:

Column 2, Line 26 between "Top" and "56" insert --end--.

Column 4, Line 11, delete "said" first occurrence.

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*